United States Patent [19]

Ziegelmuller et al.

[11] Patent Number: 4,851,880

[45] Date of Patent: Jul. 25, 1989

[54] CLEANING APPARATUS HAVING AIRFOILS

[75] Inventors: Francisco L. Ziegelmuller, Penfield; Carl R. Bothner, Rochester, both of N.Y.

[73] Assignee: Eastman Kodak Company, Rochester, N.Y.

[21] Appl. No.: 211,021

[22] Filed: Jun. 24, 1988

[51] Int. Cl.[4] ..... G03G 21/00

[52] U.S. Cl. ..... 355/302; 15/308

[58] Field of Search ..... 355/15; 118/652; 430/125; 15/256.5, 256.51, 256.52, 308

[56] References Cited

U.S. PATENT DOCUMENTS

| | | | |
|---|---|---|---|
| 4,304,026 | 12/1981 | Borostyan | 355/15 X |
| 4,435,073 | 3/1984 | Miller | 355/15 |

FOREIGN PATENT DOCUMENTS

| | | | |
|---|---|---|---|
| 56-47080 | 4/1981 | Japan | 355/15 |
| 60-115980 | 6/1985 | Japan | 355/15 |
| 60-130783 | 7/1985 | Japan | 355/15 |

OTHER PUBLICATIONS

Research Disclosure No. 24113 (May 1984), "Cleaning Apparatus", anon.

*Primary Examiner*—Arthur T. Grimley
*Assistant Examiner*—J. Pendegrass
*Attorney, Agent, or Firm*—Tallam I. Nguti

[57] ABSTRACT

A brush-vacuum cleaning apparatus, for removing toner particles from the image-bearing surface of a copier or printer, includes an airfoil located on the inside wall of a cylindrical brush housing. The airfoil relative to the rotation of the brush is positioned adjacent to, and on the upstream side of, a perpendicular slot that connects the interior of the brush housing to a vacuum source. The airfoil contacts and compresses the rotating fibers of the brush causing the fibers to rub against one another and thereby to loosen the toner particles entrained therein. In addition, the airfoil serves to aerodynamically deflect and accelerate the airstream moving with the fibers, deep into the fibers, thereby flushing the loose toner particles out of the brush and out of the housing.

7 Claims, 4 Drawing Sheets

CLEANING APPARATUS HAVING AIRFOILS

BACKGROUND OF THE INVENTION

This invention relates to electrostatographic process equipment and, more particularly, to a brush apparatus for cleaning toner and other particles from the image-bearing surfaces of such equipment.

In electrostatographic process equipment, desired toned images are produced or reproduced, through a repeatable cycle, on selected receivers by employing electrostatic charges and toner on an insulated image-bearing surface. A typical cycle includes the steps of (1) using electrostatic charges in some manner to form a latent image on the image-bearing surface; (2) develping this image with particles of toner; (3) transferring the toned image to a receiver; and (4) cleaning residual toner and other particles from the image-bearing surface in preparation for repeating the cycle.

The quality of images obtained by repeating these steps depends significantly on the ability to clean the image-bearing surface before it is reused. The cleaning step is, therefore, important and has led to the development of may cleaning methods and apparatus. One such method and apparatus utilizes a rapidly rotating fiber brush to sweep the residual toner and other particles from the image-bearing surface. In ths method and apparatus, the brush is mounted within and spaced from a housing that is typically connected to a vacuum system for transporting the brush-swept particles out of, and away from, the housing.

In order for this method of cleaning to remain effective after an initial period, the brush must itself be effectively cleaned before it recontacts and attempts to clean the image-bearing surface. This is because toner particles, removed from the image-bearing surface by the brush, become entrained in the fibers.

Attempting to clean the image-bearing surface with such particle-laden fibers usually results in redeposition of some of the particles back on such surface. It also results in scumming, and in increased water and tear of the surface. Redeposition occurs because some of the toner particles in the fibers are flung by the rotating fibers against the surface, especially on the area downstream of the point where the brush contacts and cleans such surface.

Scumming is the formation, over a period of time, of an undesirable film on the image-bearing surface due to some of the particles fusing to that surface. Such fusion occurs because of a combination of reduced airflow and increased friction from the particle-laden fibers sweeping against the surface. Such particle-laden fibers, in addition, act as an abrasive, and therefore can accelerate and increase surface wear and tear. In brush cleaning, therefore, it is important to thoroughly remove toner particles from the rotating brush fibers before the fibers recontact the image-bearing surface.

SUMMARY OF THE INVENTION

It is an object of the present invention to provide an improved brush cleaning apparatus for removing toner and other particles from an image-bearing surface.

It is also an object of the present invention to substantially reduce toner particle redeposition on the image-bearing surface, as well as, the scumming and rate of wear and tear of such surface.

In accordance with the present invention, a cleaning apparatus is provided for removing toner and other particles from the image-bearing surface of an electrostatographic copier or printer as the surface is moved past the cleaning apparatus. The apparatus comprises a fiber brush, with radially protruding fibers that contact the image-bearing surface as the brush is rotated about an axis for sweeping toner and other particles from such surface. An elongate housing substantially surrounding the brush, has a generally cylindrical inside wall and a longitudinal opening facing and spanning the width of the moving image-bearing surface. The housing also has a longitudinal slot that is cut perpendicularly into the housing, and that is spaced about 180 degrees from such opening. A vacuum source is connected to the housing through the slot. More particularly, an airfoil is provided on the inside wall of the housing for contacting and incrementally compressing the rotating fibers. The airfoil, relative to the rotating fibers, is positioned adjacent to, and on the upstream side of the slot. Besides compressing the fibers to loosen the toner particles therefrom, the airfoil also aerodynamically deflects and accelerates the airstream moving with the fibers, deep into such fibers, thereby flushing the loose toner particles out of the brush and out of the housing.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

The present invention will now be described with reference to its preferred embodiments as used on the imaging loop of an electrophotographic copier or printer.

Figure 1:
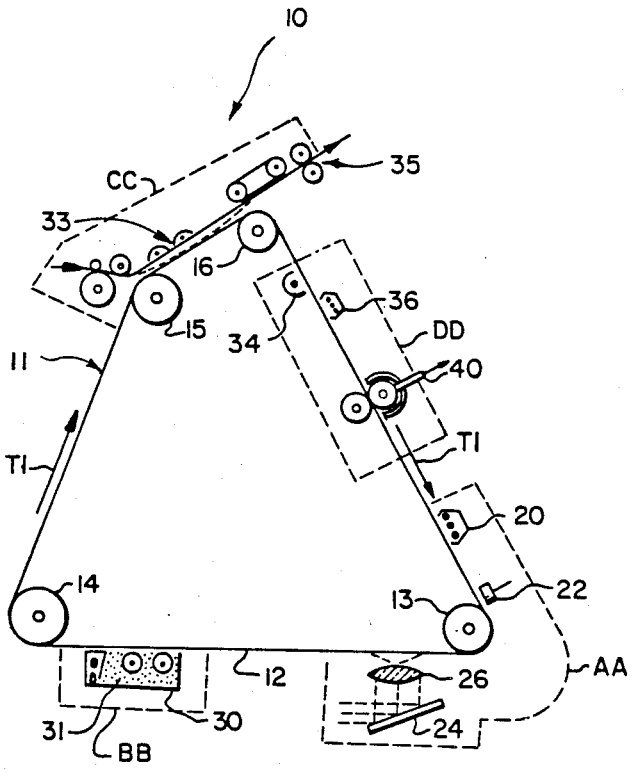
FIG. 1 is a schematic view of the image loop of an electrophotographic copier or printer incorporating a cleaning apparatus of the present invention.

Referring now to FIG. 1, the imaging loop 10 includes a member 11, shown in the form of an endless belt having an image-bearing surface 12. Member 11 is trained about rollers 13 through 16 for movement in the direction indicated by the arrows T1 past a series of stages AA, BB, CC and DD. One roller such as roller 13, can be a drive roller for moving member 11. The member 11 can also be a rigid drum.

Initially, clean and charge-free portions of the image-bearing member 11 move through the stage AA where electrostatic charges and/or light, are used in one manner or another (as is well known in the art) to form electrostatic images on the surface 12. Typically, the stage AA includes contamination sensitive components such as the primary charger 20 or other charge depositing component (not shown). The electrostatic image can be formed on the surface 12, for example, by charging the surface using the primary charger 20, and then selectively discharging portions of it using an electronic printhead 22 and/or an optical system. A typical optical system has a light source (not shown) that illuminates a document sheet, with the light rays from the sheet being reflected by a mirror 24 through a lens 26 to the surface 12. This portion of the image-bearing member 11 carrying the electrostatic image on the surface 12 next moves to stage BB where the image is developed with particles of toner.

Stage BB normally includes a development station 30 that contains a developer material 31 that can be made up of toner particles only, or of a mixture of carrier particles and toner particles. During the development of the image, toner particles adhere to the electrostatic charges forming the image, thus making the image visible. Although undesirable, some carrier particles along with the toner particles, also adhere to the image. After development, this portion of the image-bearing member 11 carrying the developed image on the surface 12, next moves to stage CC.

Stage CC usually includes an image transfer station 33 where the visible toner image on the surface 12 is transferred to a suitable receiver such as a sheet of paper that is fed in registration to the station 33 along a sheet travel path. After such transfer, the copy sheet then travels to a fusing station 35 where the image is permanently fused to the receiver.

By the time an initially clean and charge-free portion of the image-bearing member 11 has moved past the stage CC, it normally has residual charges as well as residual toner and other particles on it. In order to ensure high image quality during subsequent cycles of the imaging process, it is necessary to remove such residual charges and residual particles from the surface 12, before each such portion again goes through the steps of image formation, development and transfer. Such cleaning is carried out at stage DD where the residual charges are removed by a discharge lamp 34 and/or neutralized by a corona 36, and the residual particles are removed by a cleaning apparatus, generally designated 40.

Figure 2:
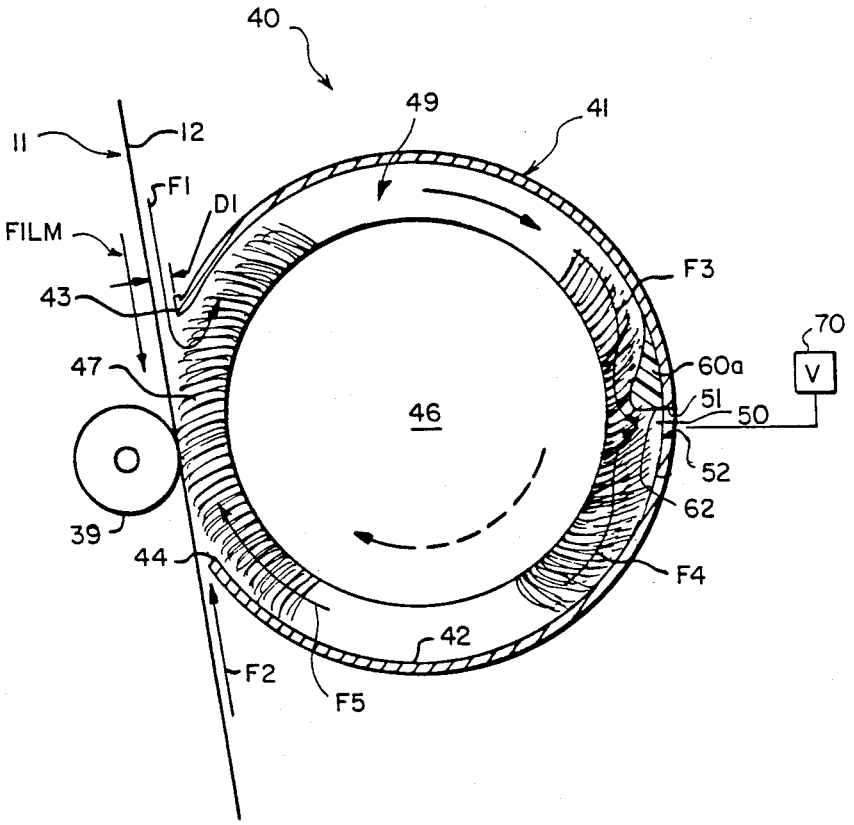
FIG. 2 is a cross-sectional view of the present invention shown in contact with the image-bearing surface being cleaned.
Figure 3:
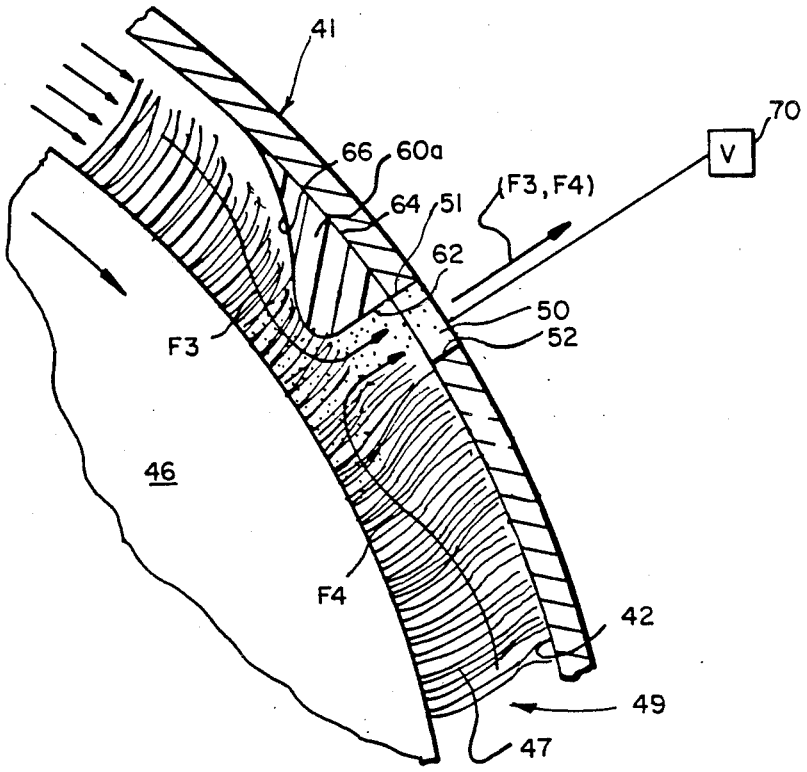
FIG. 3 is an enlarged sectional view of the airfoil of the present invention.

Referring now to FIGS. 2 and 3, the cleaning apparatus 40 is positioned in front of, and spaced by a distance D1 from the image-bearing surface 12 of member 11, at a point where the member 11 rides over a support roller 39 located on the backside of member 11.

The apparatus 40 comprises an elongate housing 41 that is positioned adjacent the surface 12 of member 11, and extends substantially the full width of such surface. The housing 41 has a generally cylindrical inner wall 42 that defines a chamber 49, and a rectangular opening into the chamber 49 that is defined by edges 43, 44. The housing 41 is mounted such that this opening faces, as well as, spans the width of the surface 12.

A cylindrical cleaning brush 46 positioned within the housing 41, is substantially co-axial with the inner wall 42. Brush 46 has a cylindrical core that is about 2.84 inches in diameter and that is covered with radially protruding fibers 47. The fibers 47 have an average pile height of about 0.295 inch and extend through the opening defined by edges 43, 44 to contact and sweep the image-bearing surface 12. In order to keep the inside wall of the housing free of particle buildups, the brush 46 and the housing 41 are selected such that the brush fits closely within the inner wall 42 with a tolerance of ±0.02 inch. The brush may also be selected such that the outer diameter of the housing. To clean the surface 12, the brush 46 is rotated by suitable drive means in a clockwise direction, as shown in FIG. 2, or typically in a direction opposite to the direction of movement of the surface 12.

The housing 41 also has a perpendicular slot 50 that is cut therein, spaced about 180 degrees circumferentially from the edges 43, 44. The slot 50 is defined by lip 51 which relative to the rotation of the brush is upstream, and by lip 52 which respectively is downstream. A vacuum source 70 is connected across the slot 50, and combines with the rotating fibers 47 to pull two airstreams F1, F2 at the edges 43, 44 into the housing 41, and two airstreams F3 and F4 through the housing 41 into the slot 50. Although the tendency of the fibers 47 at the downsteam lip 52 of slot 50 is to continue to move an airstream F5 clockwise through the housing, it is believed that due to the vacuum source 70, there is an airstream F4, flowing counterclockwise close to the lip 52 into the slot 50.

Inside the housing 41, an airfoil 60A is positioned against the inner wall 42 close to the slot 50. Airfoil 60A is a generally triangular member with a narrow flat base 62 and curved sides 64, 66 forming its apex, that is, the vertex opposite the base 62. The curve of the side 64 is convex, and its radius of curvature is equal to that of the inner wall 42. The curve of the other side 66 is aerodynamically designed to be slightly concave. For similar aerodynamic reasons, the corner between the side 66 and the flat base 62 is rounded. The airfoil 60A is positioned on the inside wall 42 with the side 64 connected to and sealed against the inner wall 42. The flat base 62 is adjacent to and aligned with the upstream lip 51 of slot 50. When so positioned, the airfoil 60A preferably projects 0.060±0.030 inch into the chamber 49 and consequently into the pile of the fibers 47. Because of this projection, the side 66 contacts and interferes increasingly with both the rotating fibers 47 and the airstream F3 as they move towards the slot 50.

Figure 4:
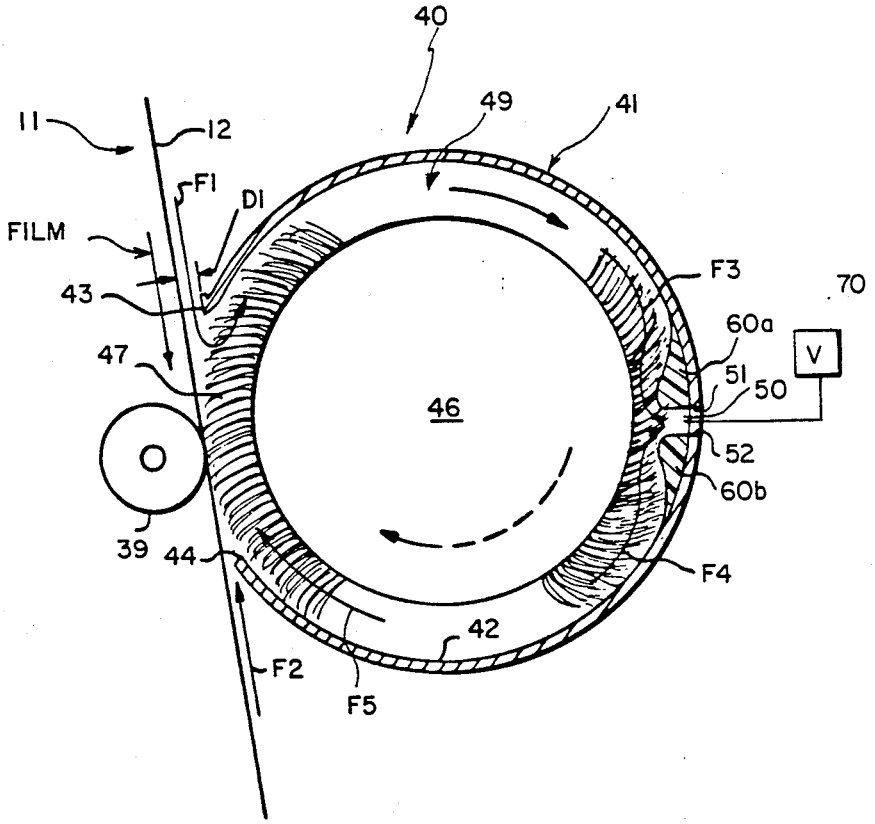
FIG. 4 is a cross-sectional view of an embodiment of the present invention with two airfoils.

In a varied embodiment of the invention as shown in FIG. 4, a second airfoil 60B, in addition, is utilized on the downstream lip 52. The airfoil 60B is the same shape and size as airfoil 60A. As positioned adjacent to, and aligned with the downstream lip 52 of slot 50, airfoil 60B simply mirrors the positioned airfoil 60A, and affects the airstream F4 in much the same manner as the airfoil 60A affects airstream F3. The effect of the airfoil 60B on the rotating fibers 47, however, is not the same as that of the airfoil 60A on such fibers, as will be made clear below.

The operation of the cleaning apparatus 40 of the present invention will now be described.

With the member 11 being moved about the rollers 13 through 16 in the direction of the arrows T1, clean and charge-free portions of the image-bearing surface 12 pass successively through the stages AA, BB, and CC. In stages AA, BB, and CC, electrostatic images are formed, developed and transferred to copy sheets. By the time each of these portions of the moving surface 12 reaches stage DD, it normally is contaminated with residual charges, and residual toner particles. In order to continue to obtain high quality images, it is necessary to remove these residual charges and particles before each such portion again enters stage AA to restart the imaging cycle. Accordingly, at stage DD, lamp 34 and/or a corona 36, remove the residual charges, and the cleaning apparatus 40 removes the residual toner particles.

To use the cleaning apparatus 40 on the moving surface 12, the vacuum source 70 is first activated, and the brush 46 is then rotated in a direction opposite to that of the moving surface 12 or in a clockwise direction (as shown). The brush fibers 47 during such rotation contact and sweep residual particles from the image-bearing surface 12 as the surface moves over the backup roller 39. The combined effect of the rotating fibers 47 and the vacuum source 70 is to pull airstreams F1, F2 into the housing 41, and airstreams F3 and F4 through the housing 41 towards, and out of the slot 50. A residual airstream F5 is maintained by the fibers 47 downstream of the vacuum slot 50. Within the housing 41, the airstream F3 which can be viewed as the total of airstreams F1, F2 and F5, combines with the fibers 47 to rapidly move the swept-off particles away from the surface 12, through the housing 41 and towards the slot 50.

As the airstream F3 and the fibers 47 come against, and begin to pass over the airfoil 60A towards the slot 50, increasing amounts of the airstream F3 contact and are deflected by the side 66, causing more and more of the stream F3 to flow deep into the fibers 47. The side 66 of airfoil 60A also has a throttling effect, accelerating the airstream F3 as it moves towards the slot 50. Simultaneously, the fibers 47 also contact and are increasingly compressed by the side 66 as the fibers move towards the slot 50. This increasing compression of the fibers 47 causing the fibers to contact and rub against one another, thus loosening and freeing the toner particles, entrained therein, into the airstream F3. The combined effect of this loosening of the particles, and of the acceleration of the airstream F3 into the fibers 47, is to substantially clean the brush by flushing the particles out of each portion of the brush as such portion approaches the slot 50.

The increasing compression of the fibers also reduces the radius of rotation of the tips of these fibers, therefore tending to slow down the velocity of the tips as they move towards the slot 50. Such a slowing down of the tips of the rotating fibers 47 consequently increase the time available to loosen and remove the particles thereon.

Once the compressed and slowed up fibers 47 reach the slot 50 and are released by the airfoil 60A, they, of course, spring back and resume their initial protruding shapes and velocity through the housing 41. In addition, as the airstream F3 which had been deflected by the side 66 deep into the fibers 47 reaches the slot 50, it encounters a sudden change in direction as it is released and sucked out through the perpendicular slot 50. Meanwhile, the airstream F4, which because of the opposing effect of the rotating fibers 47 is not as strong as the airstream F3, also operates to flush toner particles out of the fibers and out of the housing 41.

In the second preferred embodiment where a second airfoil 60B as shown in FIG. 4 is utilized on the lip 52, the airfoil 60B operates to balance airflow into the housing through the edges 43, 44, and to keep the fibers 47 compressed and slowed down as they move across the slot 50. Airfoil 60B, because of its orientation, then gradually, releases the fibers 47 from their compressed state back to their normal protrusions on the brush 46 as they move on downstream of the slot 50. The airstream F4 as it flows into the slot 50, is accelerated over airfoil 60B also carrying with it loose toner particles.

Although the invention has been described in detail with particular reference to preferred embodiments thereof, it will be understood that variations and modifications can be effected within the scope and spirit of the invention.

What is claimed is:

1. A cleaning apparatus for removing toner and other particles from the image-bearing surface of an electrostatographic copier or printer as the surface is moved past the apparatus, the apparatus comprising:

(a) a brush rotatable about an axis for sweeping toner and other particles from the image-bearing surface, said brush having fibers protruding radially therefrom;

(b) a housing substantially surrounding said brush, said housing having a generally cylindrical inside wall, an opening facing the image-bearing surface through which said fibers extend to sweep against the image-bearing surface, and a slot cut in said housing at a point spaced circumferentially from said opening, said slot having a lip upstream and a lip downstream relative to the rotation of said brush;

(c) a vacuum source connected to said housing across said slot for pulling airstreams into, through and out of said housing; and (d) an airfoil, generally triangular in cross-section, positioned within said housing with its apex and with its base in alignment with said upstream lip of said slot, said airfoil being effective for compressing, slowing down and causing said fibers to rub against one another thereby loosening toner particles entrained therein, and for aerodynamically accelerating such particles out of said fibers and said housing.

2. The cleaning apparatus of claim 1, wherein said slot is perpendicularly cut into said housing.

3. The cleaning apparatus of claim 1, further including a second airfoil positioned within said housing adjacent to, aligned with said downstream lip and shaped to form a mirror image of said upstream airfoil.

4. A device usable, within the housing of a brush-vacuum cleaning apparatus as an airfoil, to gradually and incrementally compress the fibers of a moving brush as such fibers move towards a vacuum port within the housing, and to aerodynamically deflect and accelerate an airstream moving with the fibers deep into such fibers, said device including:

a. a short straight base;

b. a first curved side longer than and adjoining said base, and suitable for connecting to and sealing its entire length against the inside wall of the brush housing such that said base projects into the housing to interfere with the moving brush fibers and with an airstream moving with such fibers; and c. a second curved side adjoining said first side at an acute angle, and said straight base, forming a generally triangular member and a path of gradual and incremental interference for the moving brush fibers and the airstream moving with such fibers.

5. The device of claim 4 wherein said base and said second side are each impermeable to air, and effective to deflect an airstream moving thereagainst.

6. The device of claim 4 wherein the corner formed by said second side and said base is rounded to substantially reduce damage to brush fibers moving therearound.

7. The device of claim 4 wherein the curve of said second side is slightly concave and effective in aerodynamically accelerating an airstream moving thereagainst from the apex to the base of the triangular member formed by said base and said first and second sides.

* * * * *